US008880393B2

(12) United States Patent
Hershey et al.

(10) Patent No.: US 8,880,393 B2
(45) Date of Patent: Nov. 4, 2014

(54) INDIRECT MODEL-BASED SPEECH ENHANCEMENT

(75) Inventors: John R Hershey, Winchester, MA (US); Jonathan Le Roux, Somerville, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 440 days.

(21) Appl. No.: 13/360,467

(22) Filed: Jan. 27, 2012

(65) Prior Publication Data

US 2013/0197904 A1 Aug. 1, 2013

(51) Int. Cl.
*G10L 21/02* (2013.01)

(52) U.S. Cl.
USPC ..... 704/226; 704/219; 381/94.1

(58) Field of Classification Search
USPC ..... 704/226
See application file for complete search history.

(56) References Cited

U.S. PATENT DOCUMENTS 6,026,359 A * 2/2000 Yamaguchi et al. ..... 704/256.4
6,205,421 B1 * 3/2001 Morii ..... 704/226
2007/0276660 A1 * 11/2007 Pinto ..... 704/219
2010/0063807 A1 * 3/2010 Archibald et al. ..... 704/226
2010/0145687 A1 6/2010 Huo et al.

FOREIGN PATENT DOCUMENTS

EP 1465160 A2 10/2004

OTHER PUBLICATIONS

Brendan J. Frey et al. "Algonquin: Interating Laplace's Method to Remove Multiple Types of Acoustic Distortion for Robust Speech Recognition," Probabilistic Inference Group, University of Toronto, www.cs.toronto.edu/frey Speech Technology Group, Microsoft Research, www.research.microsoft.com.

Brendan J. Frey et al., "Algonquin-Learning Dynamic Noise Models from Noisy Speech for Robust Speech Recognition," Probabilistic Inference Group, University of Toronto, www.cs.toronto.edu/frey Speech Technology Group, Microsoft Research.

Pedro J. Moreno et al. "A Vector Taylor Series Approach for Environment-Independent Speech Recognition;" Department of Electrical and Computer Engineering & School of Computer Science Carnegie Mellon University Pittsburgh, Pennsylvania 15213.

* cited by examiner

*Primary Examiner* — Daniel D Abebe
(74) *Attorney, Agent, or Firm* — Dirk Brinkman; Gene Vinokur

(57) ABSTRACT

Enhanced speech is produced from a mixed signal including noise and the speech. The noise in the mixed signal is estimated using a vector-Taylor series. The estimated noise is in terms of a minimum mean-squared error. Then, the noise is subtracted from the mixed signal to obtain the enhanced speech.

9 Claims, 1 Drawing Sheet

INDIRECT MODEL-BASED SPEECH ENHANCEMENT

FIELD OF THE INVENTION

This invention is related generally to a method for enhancing signals including speech and noise, and more particularly to enhancing the speech signals using models.

BACKGROUND OF THE INVENTION

Model-based speech enhancement methods, such as vector-Taylor series (VTS)-based methods use statistical models of both speech and noise to produce estimates of an enhanced speech from a noisy signal. In model-based methods, the enhanced speech is typically estimated directly by determining its expected value according to the model, given the noise.

Direct Vector-Taylor Series-Based Methods

In high-resolution noise compensation techniques, the mixed speech and noise signals are modeled by Gaussian distributions or Gaussian mixture models in the short-time log-spectral domain, rather than in a feature domain having a reduced spectral resolution, such as the mel spectrum typically used for speech recognition. This is done, along with using the appropriate complementary analysis and synthesis windows, for the sake of perfect reconstruction of the signal from the spectrum, which is impossible in a reduced feature set.

Here, the short-time speech log spectrum $x_t$ at frame t is conditioned on a discrete state $s_t$. The noise is quasi-stationary, hence only a single Gaussian distribution is used for the noise log spectrum $n_t$:

$$p(x_t, s_t) = p(s_t)\mathcal{N}(x|\mu_{x|s_t}, \Sigma_{x|s_t}), \quad p(n_t) = \mathcal{N}(n_t|\mu_n, \Sigma_n), \tag{1}$$

where $\mathcal{N}(\cdot|\mu, \Sigma)$ denotes the Gaussian distribution $\mathcal{N}$ with mean $\mu$ and variance $\Sigma$.

The log-sum approximation uses the logarithm of the expected value, with respect to the phase, in the power domain to define an interaction distribution over the observed noisy spectrum $y_{f,t}$ in frequency f and frame t:

$$p(y_{f,t}|x_{f,t}, n_{f,t}) \stackrel{def}{=} \mathcal{N}(y_{f,t}|\log(e^{x_{f,t}} + e^{n_{f,t}}), \psi_f), , \tag{2}$$

where $\Psi=(\psi_f)_f$ is a variance intended to handle the effects of phase.

To perform inference in this model requires determining the following likelihood and posterior integrals $$p(y_t|s_t) = \int p(y_t|x_t, n_t)p(n_t)p(x_t|s_t)dx_t dn_t, \tag{3}$$

$$E(x_t|s_t) = \int x_t p(x_t, n_t|y_t, s_t)dx_t dn_t, \tag{4}$$

$$= \int x_t \frac{p(y_t|x_t, n_t)p(n_t)p(x_t|s_t)}{p(y_t|s_t)} dx_t dn_t. \tag{5}$$

These integrals are intractable due to the nonlinear interaction function in Eqn. (2). In iterative VTS, this limitation is overcome by linearizing the interaction function at the current posterior mean, and then iteratively refining the posterior distribution.

In the following, the variable t is omitted for clarity. To simplify the notation, x and n can be concatenated to form a joint vector z=[x;n], where ";" indicates a vertical concatenation. The prior probability is defined as $$p(z|s) = \mathcal{N}(z|\mu_{z|s}, \Sigma_{z|s}), ,$$

where $$\mu_{z|s} = \begin{bmatrix} \mu_{x|s} \\ \mu_n \end{bmatrix}, \Sigma_{z|s} = \begin{bmatrix} \Sigma_{x|s} & 0 \\ 0 & \Sigma_n \end{bmatrix}. \tag{6}$$

The interaction function is defined as $g(z)=\log(e^x+e^n)$, where the log and exponents operate element-wise on x and n.

The interaction function is linearized at $\tilde{z}_s$, for each state s, yielding:

$$p_{linear}(y|z;\tilde{z}_s)=\mathcal{N}(y;g(\tilde{z}_s)+J_g(\tilde{z}_s)(z-\tilde{z}_s),\Psi), \tag{7}$$

where $J_g(\tilde{z}_s)$ is the Jacobian matrix of g, evaluated at $\tilde{z}_s$:

$$J_g(\tilde{z}_s) = \frac{\partial g}{\partial z}\Big|_{\tilde{z}_s} = \left[\mathrm{diag}\left(\frac{1}{1+e^{\tilde{n}_s-\tilde{x}_s}}\right) \mathrm{diag}\left(\frac{1}{1+e^{\tilde{x}_s-\tilde{n}_s}}\right)\right]. \tag{8}$$

The likelihood is $$p(y|s;\tilde{z}_s) = \mathcal{N}(\mu_{y|s;\tilde{z}_s}, \Sigma_{y|s;\tilde{z}_s}), \tag{9}$$

where $$\mu_{y|s;\tilde{z}_s} = g(\tilde{z}_s) + J_g(\tilde{z}_s)(\mu_{z|s} - \tilde{z}_s), \quad \Sigma_{y|s;\tilde{z}_s} = \Psi + J_g(\tilde{z}_s)\Sigma_{z|s}J_g(\tilde{z}_s)^T. \tag{10}$$

The posterior state probabilities are $$p(s|y;(\tilde{z}_{s'})_{s'}) = \frac{p(y|s;\tilde{z}_s)}{\sum_{s'} p(y|s';\tilde{z}_{s'})}. \tag{11}$$

The posterior mean and covariance of the speech and noise are $$\mu_{z|y,s;\tilde{z}_a}=\mu_{z|s}+\Sigma_{z|s}J_g(\tilde{z}_s)^T\Sigma_{y|s;\tilde{z}_a}^{-1}(y-g)(\tilde{z}_s)-J_g(\tilde{z}_s)(\mu_{z|s}-\tilde{z}_s))$$

$$\Sigma_{z|y,s,\tilde{z}_s}=[\Sigma_{z|s}^{-1}+J_g(\tilde{z}_s)^T\Psi^{-1}J_g(\tilde{z}_s)]^{-1}. \tag{12}$$

Iterative VTS updates the expansion point $\tilde{z}_{s,k}$ in each iteration k as follows.

The expansion point is initialized to the prior mean $\tilde{z}_{s,1}=\mu_{z|s}$, and is subsequently updated to the posterior mean of the previous iteration $$\tilde{z}_{s,k}=\mu_{z|y,s;\tilde{z}_{s,k-1}}.$$

Although $p(y|s;\tilde{z}_{s,k})$ is a Gaussian distribution for a given expansion point, the value of $\tilde{z}_{s,k}$ is the result of iterating and depends on Y nonlinearly, so that the overall likelihood is non-Gaussian as a function of y. The posterior means of the speech and noise components are sub-vectors of $$\mu_{z|y,s;\tilde{z}_s}=[\mu_{x|y,s;\tilde{z}_s};\mu_{n|y,s;\tilde{z}_s}].$$

The conventional method uses the speech posterior expected value to form a minimum mean-squared error (MMSE) estimate of the log spectrum:

$$\hat{x} = \sum_s p(s|y; (\tilde{z}_{s'})_{s'})\mu_{x|y,s;\tilde{z}_s}. \tag{13}$$

For each frame t, the MMSE speech estimate is combined with the phase $\theta_t$ of the noisy spectrum to produce a complex spectral estimate, $$\hat{X}_t = e^{\hat{x}_t + i\theta_t}, \tag{14}$$

called the VTS MMSE.

SUMMARY OF THE INVENTION

Model-based speech enhancement methods, such as vector-Taylor series (VTS)-based methods, share a common methodology. The methods estimate speech using an expected value of enhanced speech, given noisy speech, according to a statistical model.

The invention is based on the realization that it can be better to use an expected value of the noisy speech according to the model, and subtract the expected value from the noisy observation to form an indirect estimate of the speech.

DETAILED DESCRIPTION OF THE PREFERRED EMBODIMENT

Figure 1:
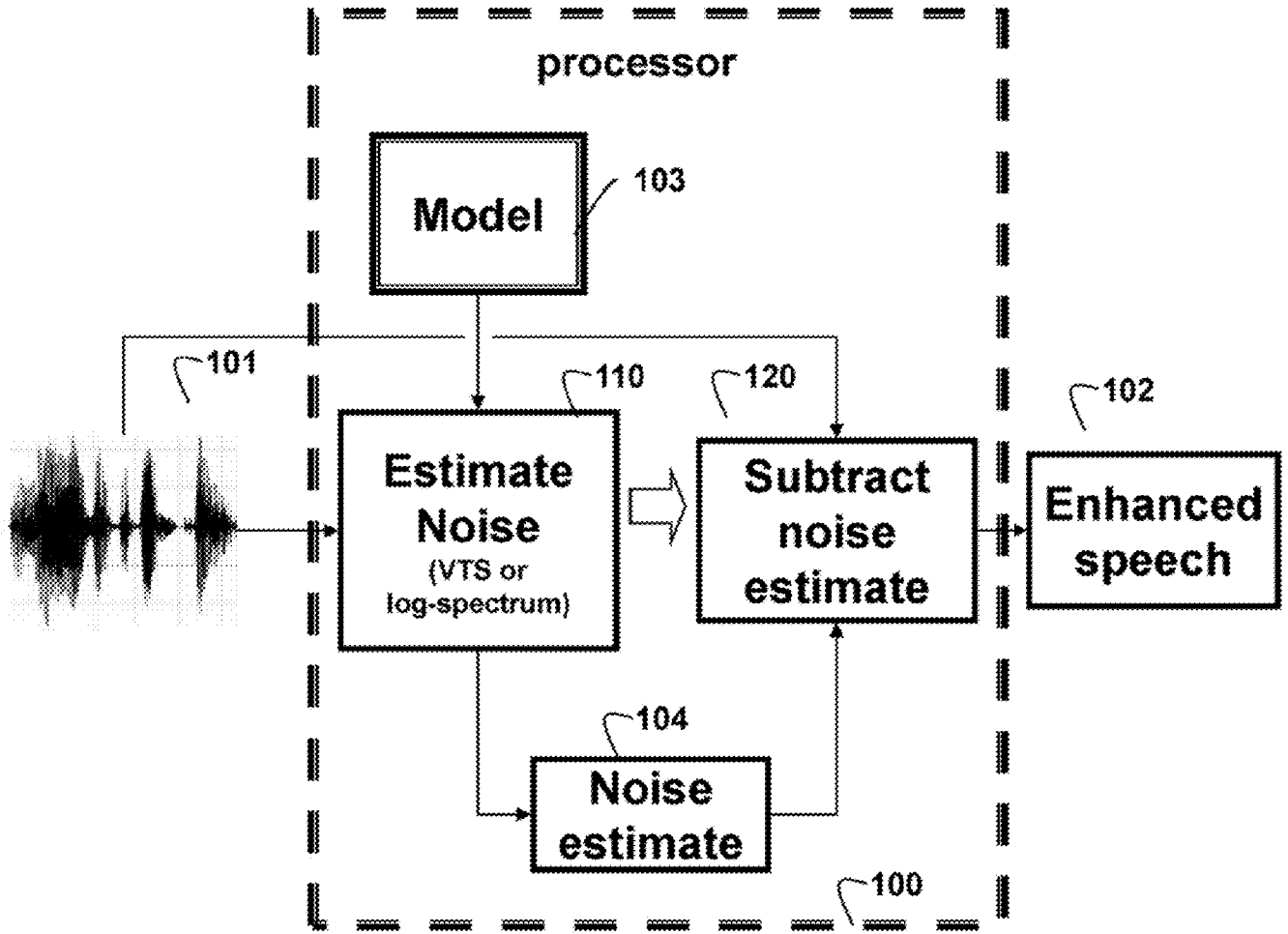
FIG. 1 is a block diagram of a speech enhancement method according to embodiments of the invention.

In direct vector-Taylor series (VTS)-based methods, the MMSE estimates of the speech and noise in mixed signals are not symmetric, in the sense that the estimates do not necessarily add up to the acquired signals.

In model-based approaches, there is always the risk of mismatch between the speech model and the acquired speech, as well as errors due to an approximation in an interaction model. The MMSE of the speech estimate can be distorted during the estimation process.

A better approach, according to the embodiments of the invention, avoids over-committing to the speech model. Instead, the noise is estimated, and the noise estimate is then subtracted from the mixed speech and noise signals to obtain enhanced speech.

FIG. 1 shows a method for enhancing speech using an indirect VTS-based method according to embodiments of our invention. Input to the method is a mixed speech and noise signal 101. Output is enhanced speech 102. The method uses a VTS model 103. Using the model, an estimate 110 of the noise 104 is made. The noise is then subtracted 120 from the input signal to produce the enhance speech signal 102.

The steps of the above methods can be performed in a processor 100 connected to memory and input/output interfaces as known in the art.

Indirect VTS-Based Method

A MMSE estimate ("^") of noise is $$\hat{n} = \sum_s p(s|y; (\tilde{z}_{s'})_{s'})\mu_{n|y,s;\tilde{z}_s}, \tag{15}$$

where s is a speech state, y is a noisy speech log spectrum, $\tilde{z}_s$ is an expansion point for the VTS approximation, μ is a mean, and $p(s|y;(\tilde{z}_{s'})_{s'})$ is a conditional probability of the speech state given the noisy speech and the expansion points.

We can subtract the MMSE estimate of the noise from the acquired mixed speech and noise signals to estimate a complex spectra:

$$\begin{aligned}\tilde{X}_t &= Y_t - e^{\hat{n}_t + i\theta_t} \\ &= \left(e^{y_t} - e^{\hat{n}_t}\right)e^{i\theta_t},\end{aligned} \tag{16}$$

which we refer to as the indirect VTS logarithmic (log)-spectral estimator.

This expression is more complex than conventional spectral subtraction. Unlike spectral subtraction, the noise estimate that is subtracted here, in a given time-frequency bin, is estimated according to statistical models of speech and noise, given the acquired mixed signal.

Factors for Independently Increasing the SDR

In addition to our estimation process, we describe three other factors, each of which independently increases the average signal-to-distortion ratio (SDR) improvement in an empirical evaluation.

Acoustic Model A Weights

A first factor is to impose acoustic model weights $\alpha_f$ for each frequency f. These weights differentially emphasize the acoustic-likelihood scores as compared to the state prior probabilities. This only affects estimation of the speech-state posterior probability $$p(s|y; (\tilde{z}_{s'})_{s'}) = \frac{\Pi_f\, p(y_f|(s; \tilde{z})_{f,s})^{\alpha_f}}{\Sigma_{s'}\, \Pi_f\, p(y_f|(s'; \tilde{z})_{f,s'})^{\alpha_f}}. \tag{17}$$

In speech recognition, the weights $\alpha_f$ we use depend on both pre-emphasis to remove low-frequency information, and the mel-scale, which among other things de-emphasizes the weight of higher frequency components by differentially reducing their dimensionality.

Noise Estimation

A third factor concerns the estimation of the mean of the noise model from a non-speech segment assumed to occur in a portion before speech in the acquired signals begins, e.g., the first few frame. The conventional method is to estimate the noise model using the mean of the non-speech in the log-spectral domain. Instead, we take the mean in the power domain, so that $$\mu_n = \log\left(\frac{1}{n}\sum_{t\in I} e^{y_t}\right), \tag{18}$$

wherein I is a set of time indices for non-speech frames.

This has the benefit of reducing the influence of small outliers, and provides a smoother estimate. The variance about the mean is determined in the usual way.

Effect of the Invention

The invention provides an alternative to conventional model-based speech enhancement methods. Whereas those methods focus on reconstruction of the expected value of the speech given the acquired mixed speech and noise speech signals, we determine the enhanced speech from the expected value of the noise signal. Although the difference is conceptually subtle, the gains in enhancement performance on a VTS-based model are significant.

In results obtained in an automotive application with a noisy environment, our methodology produces an average improvement of the signal-to-noise ratio (SNR), relative to conventional methods. Relative to the direct VTS approach, other conventional approaches, such as the combination of Improved Minimal Controlled Recursive Averaging (IMCRA) and Optimal Modified Minimum Mean-Square Error Log-Spectral Amplitude (OMLSA) performed better than direct VTS. However, the indirect VTS is still 0.6 dB better than that.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

We claim:

1. A method for enhancing speech in a mixed signal, wherein the mixed signal includes a noise signal and a speech signal, comprising the steps of:

determining an estimate of noise in the mixed signal, where the determining uses a probabilistic model of the speech signal, the noise signal, and the mixed signal, wherein the probabilistic model is defined in a logarithm-spectrum-based domain; and subtracting the estimate of the noise from the mixed signal to obtain the enhanced speech, wherein the subtracting produces a complex spectra $$\hat{X}_t=(e^{y_t}-e^{\hat{n}_t})e^{i\theta_t},$$

wherein t is a time frame, $y_t$ is a noisy speech log spectrum, $\hat{n}_t$ is the estimate of noise, and $\theta_t$ is a phase of the noisy speech log spectrum, wherein the steps are performed in a processor.

2. The method of claim 1, wherein the estimate of the noise is based on a posterior minimum mean squared error criterion.

3. The method of claim 1, wherein the estimate of the noise is based on a maximum a posteriori (MAP) probability criterion.

4. The method of claim 1, wherein the determining uses a vector-Taylor series (VTS) based method.

5. The method of claim 4, wherein the estimate of the noise is $$\hat{n}=\sum_s p(s|y;(\tilde{z}_{s'})_{s'})\mu_{n|y,s;\tilde{z}_s},$$

where s a state of the speech, y is a noisy speech log spectrum, $\tilde{z}_s$ is an expansion point of the VTS based method, μ is a mean, and $p(s|y;(\tilde{z}_{s'})_{s'})$ is a conditional probability of the state of the speech given the noisy speech log spectrum and the expansion point.

6. The method of claim 1, further comprising:

imposing acoustic model weights $\alpha_f$ for each frequency f in the noise to differentially emphasize acoustic-likelihood scores.

7. The method of claim 1, wherein the sufficient statistics of the noise model are estimated from a non-speech segment in the mixed signal.

8. The method of claim 7, wherein the mean of the noise model is estimated in a log spectrum domain according to $$\mu_n=\log\left(\frac{1}{n}\sum_{t\in I}y_t\right),$$

wherein I is a set of time indices for assumed non-speech frames, $y_t$ is a noisy speech log spectrum, and n is a number of indices in the set I.

9. The method of claim 7, wherein the mean of the noise model is estimated in a power domain according to $$\mu_n=\log\left(\frac{1}{n}\sum_{t\in I}e^{y_t}\right),$$

wherein I is a set of time indices for assumed non-speech frames, $y_t$ is a noisy speech log spectrum, and n is a number of indices m the set I.

* * * * *